US011447964B2

(12) United States Patent
Sighinolfi

(10) Patent No.: US 11,447,964 B2
(45) Date of Patent: Sep. 20, 2022

(54) LEVELLING SPACER DEVICE

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 17/324,175

(22) Filed: May 19, 2021

(65) Prior Publication Data

US 2021/0363764 A1 Nov. 25, 2021

(30) Foreign Application Priority Data

May 22, 2020 (IT) ..... 102020000012022

(51) Int. Cl.
*E04F 21/00* (2006.01)
*E04F 21/18* (2006.01)
*E04F 21/22* (2006.01)

(52) U.S. Cl.
CPC ..... *E04F 21/1877* (2013.01); *E04F 21/0092* (2013.01); *E04F 21/22* (2013.01)

(58) Field of Classification Search
CPC ... E04F 21/0092; E04F 21/22; E04F 21/1844; E04F 21/1877; E04F 13/0892; E04F 15/02005
See application file for complete search history.

(56) References Cited

U.S. PATENT DOCUMENTS 9,657,485 B2 * 5/2017 Meyers ..... E04F 21/0092
2013/0055675 A1 * 3/2013 Sighinolfi ..... E04F 15/02022 52/749.11
2014/0033640 A1 * 2/2014 Gorton ..... E04F 21/0092 52/747.11
2014/0116001 A1 * 5/2014 Ghelfi ..... E04F 21/0092 52/749.11
2020/0063448 A1 2/2020 Morrow
2020/0224434 A1 * 7/2020 Troxell ..... E04F 21/0092
2021/0131124 A1 * 5/2021 Bunch ..... E04F 21/22

FOREIGN PATENT DOCUMENTS

| | | | | |
|---|---|---|---|---|
| AU | 2019100995 | A4 | 10/2019 | |
| CN | 109322473 | A | 2/2019 | |
| EP | 3492671 | A1 | 6/2019 | |
| EP | 3569793 | A1 | 11/2019 | |
| EP | 3584389 | A1 * | 12/2019 | ..... E04F 15/02022 |
| WO | 2018227250 | A1 | 12/2018 | |
| WO | 2019194808 | A1 | 10/2019 | |

* cited by examiner

*Primary Examiner* — Babajide A Demuren
(74) *Attorney, Agent, or Firm* — Browdy and Neimark, PLLC

(57) ABSTRACT

A levelling spacer device for the laying of slab-shaped products for coating surfaces, including at least one base having a lower surface and an opposite upper surface defining a support plane for two slab-shaped products placed side by side, a spacer bridge perimetrically delimiting a through opening adapted to be crossed by a pressure wedge along a crossing direction, wherein the bridge has at least two legs placed side by side between each other along a flanking direction orthogonal to the crossing direction and each one projecting from a respective portion of the upper surface of the base, in a direction orthogonal thereto, wherein each leg of the bridge is frangibly connected to the respective base portion, and a crosspiece, which joins the top of the two legs along the flanking direction, wherein each leg has an inner sidewall and an opposite outer sidewall converging on each other.

16 Claims, 5 Drawing Sheets

LEVELLING SPACER DEVICE

TECHNICAL FIELD

The present invention relates to a levelling spacer device for the laying of slab-type manufactured products, such as tiles, slabs of natural stone or the like, for coating surfaces, such as walkable surfaces, floors, wall and ceiling coverings or the like.

PRIOR ART

In the sector of tile laying for coating surfaces, such as floors, walls and the like, the use of spacer devices is known which, in addition to equally spacing the tiles placed side by side, allow their planar arrangement, such devices are commonly called levelling spacer devices.

The levelling spacer devices of the known type generally comprise a base, which can be positioned below the laying surface of at least two adjacent tiles, from which at least a spacer bridge protrudes, adapted to contact, by means of its lateral sidewalls, the facing sidewalls of the two tiles to be placed side by side on the laying surface.

The levelling spacer device is then provided with a pressure wedge adapted to wedge between a crosspiece of the spacer bridge and the surface, in view, of the tiles resting on the base, so as to press the visible surfaces of the tiles towards the base, levelling them.

The bridge is then removed by separation from the base following the solidification of the tile laying adhesive, leaving, for single-use, the base underneath the tile laying surface incorporated in the solidified adhesive.

A need felt in these levelling spacer devices, especially in those having bridges in which the legs that determine the thickness of the joint between the tiles have a reduced thickness, for example of about 1 mm or less, and which therefore allow to significantly reduce the distance between two adjacent tiles, is the fact that this bridge is not ripped off at the time of insertion of the pressure wedge, i.e. that the bridge has a high tensile strength, allowing, at the same time, to decrease the resistance to bending or shearing, i.e. to allow an effective and comfortable removal of the bridge following the solidification of the adhesive for the laying of the tiles.

In general, a need felt in these levelling spacer devices is to make the separation of the bridge from the base more and more effective and simple once the adhesive has hardened while maintaining, however, a good tensile strength of the bridge itself that is useful for effectively exercising, by means of the pressure wedge, a pressure on the tiles to be levelled.

Furthermore, a need felt in such levelling spacer devices is to guide the fracture of the bridge from the base as much as possible along pre-established and nonrandom cutting lines, limiting as much as possible that the separation line runs along random and uncontrolled paths, and—therefore—to avoid that unremoved portions of the legs of the bridge remain trapped in the joint lines between the tiles.

An object of the present invention is to meet the aforementioned need of the prior art, within the context of a simple and rational solution and at a contained cost. Such objects are achieved by the characteristics of the invention given in the independent claim. The dependent claims outline preferred and/or particularly advantageous aspects of the invention.

DISCLOSURE OF THE INVENTION

The invention, in particular, provides a levelling spacer device for the laying of slab-shaped products for coating surfaces, comprising:

- at least one base having a lower surface and an opposite upper surface defining a support plane for two slab-shaped products placed side by side;
- a spacer bridge perimetrically delimiting a through opening adapted to be crossed by a pressure wedge along a crossing direction, wherein the bridge is provided with:
- at least two legs placed side by side between each other along a flanking direction orthogonal to the crossing direction and each one projecting from a respective portion of the upper surface of the base, in a direction orthogonal thereto, wherein each leg of the bridge is frangibly connected to the respective base portion; and
- a crosspiece, which joins the top of the two legs along the flanking direction;

wherein each leg has:

- an inner sidewall provided with a top end which joins at the crosspiece and a base end which joins at the upper surface of the base, wherein the inner sidewall delimits laterally the through opening; and
- an opposite outer sidewall, wherein the outer sidewall is provided with a top end which joins at the crosspiece and a base end which joins at the base, wherein the top end of the outer sidewall is placed at a first distance along the flanking direction from the top end of the inner sidewall and the base end of the outer sidewall is placed at a second distance along the flanking direction from the base end of the inner sidewall, wherein at least one of the outer sidewall and the inner sidewall (preferably the outer sidewall) of each leg converges towards the other of the inner sidewall and the outer sidewall (preferably the inner sidewall) of the same leg, so that a ratio between the second distance and the first distance is lower than 1.

In other words, the outer sidewall and inner sidewall of each leg converge (toward each other), so that a ratio between the second distance and the first distance is lower than 1.

Thanks to this solution, it is possible to address and localize the fracture of each leg in the desired point, allowing, at the same time, a high mechanical strength of the bridge during use and also at the time when it is acted thereon with an impulsive force (a kick or a blow of a hammer or similar) suitable for triggering the fracture thereof.

Moreover, thanks to this solution, a good compromise is reached between the high tensile strength of each leg, i.e. its function as a traction element of the base under the thrust effect of the pressure wedge, and the good shear and/or flexural breakability of each leg itself, which allows the effective removal of the bridge once the tiles are firmly in place, so as to minimize the amount of residual material remaining in the interspace (or joint) between the laid tiles.

In practice, it has been observed that, thanks to such a solution, the impact zone of the device (i.e., the crosspiece or the zone proximal to the top end of the outer sidewall of each leg) is reinforced and, at the same time, the impulsive stress is effectively transmitted to the zone assigned to the fracture of the leg from the base, i.e., to the zone proximal to the base end of the outer and inner sidewalls of the legs, with the result that the fracture is driven exactly at the desired point and does not propagate randomly in the leg.

The above advantages and results are also achieved when the legs of the bridge have reduced thicknesses (i.e. when the device is used to define very small joints between very reduced tiles) for example less than or equal to 1 mm.

BRIEF DESCRIPTION OF THE DRAWINGS

Further characteristics and advantages of the invention will become clear from reading the following description provided by way of non-limiting example, with the aid of the figures illustrated in the accompanying tables.

BEST MODE OF THE INVENTION

Figure 1:
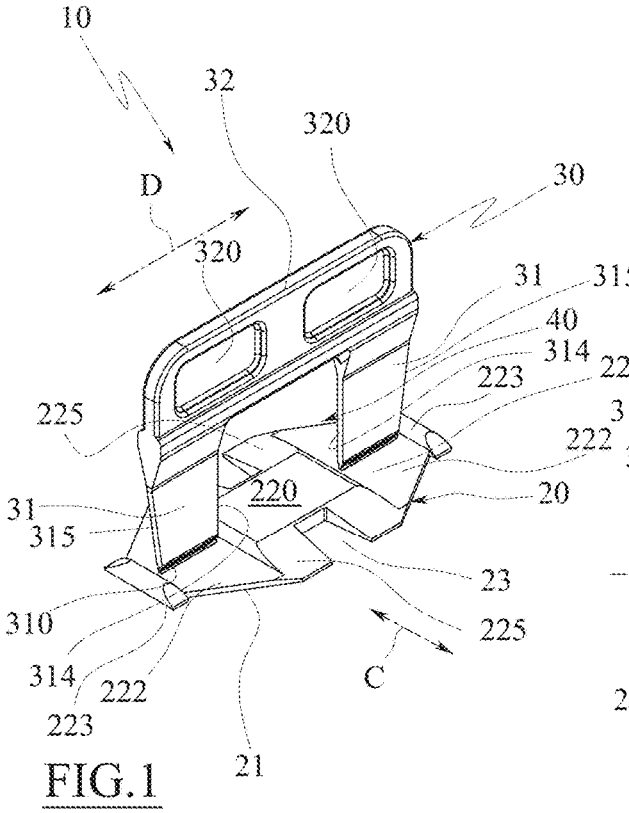
FIG. 1 is an axonometric view of an embodiment of a levelling spacer device according to the invention.
Figure 2:
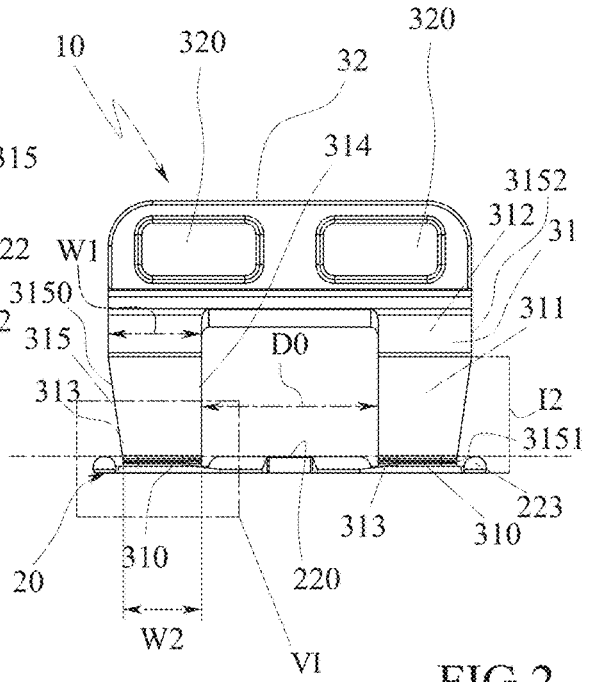
FIG. 2 is a front view of FIG. 1.
Figure 3:
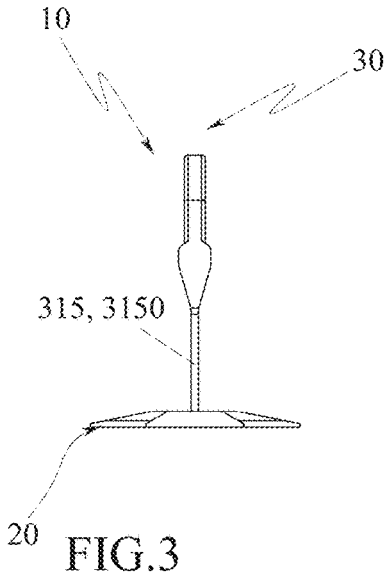
FIG. 3 is a side view of FIG. 1.
Figure 4:
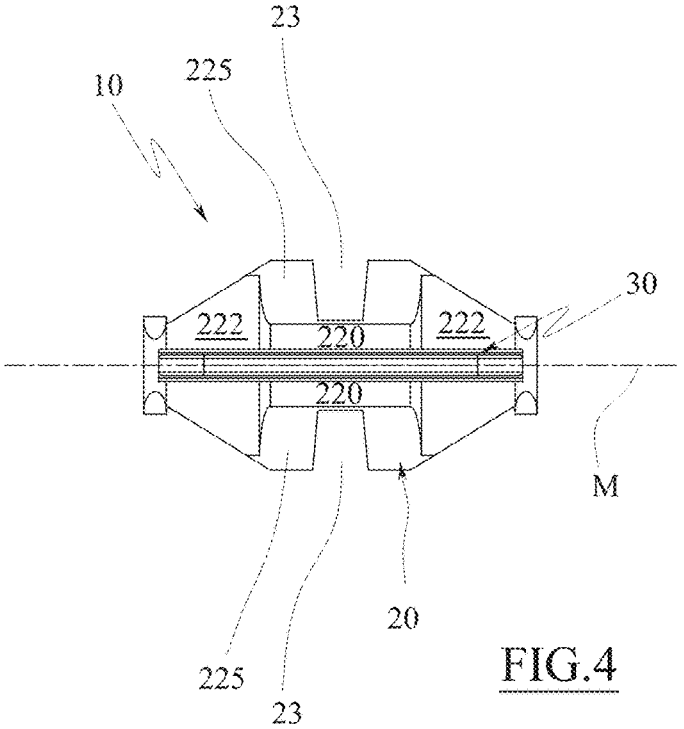
FIG. 4 is a plan view from above of FIG. 1.
Figure 5:
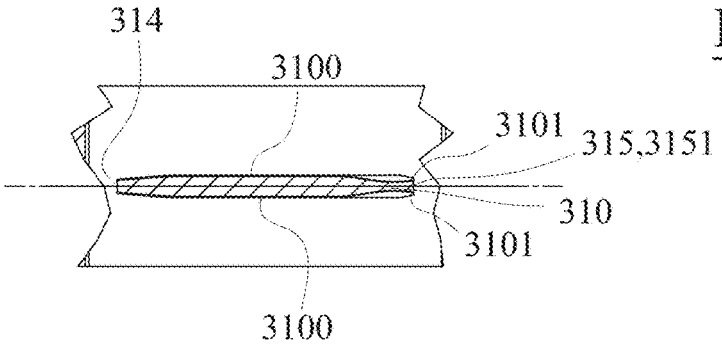
FIG. 5 is a sectional view along the trace of section V-V of FIG. 6.
Figure 6:
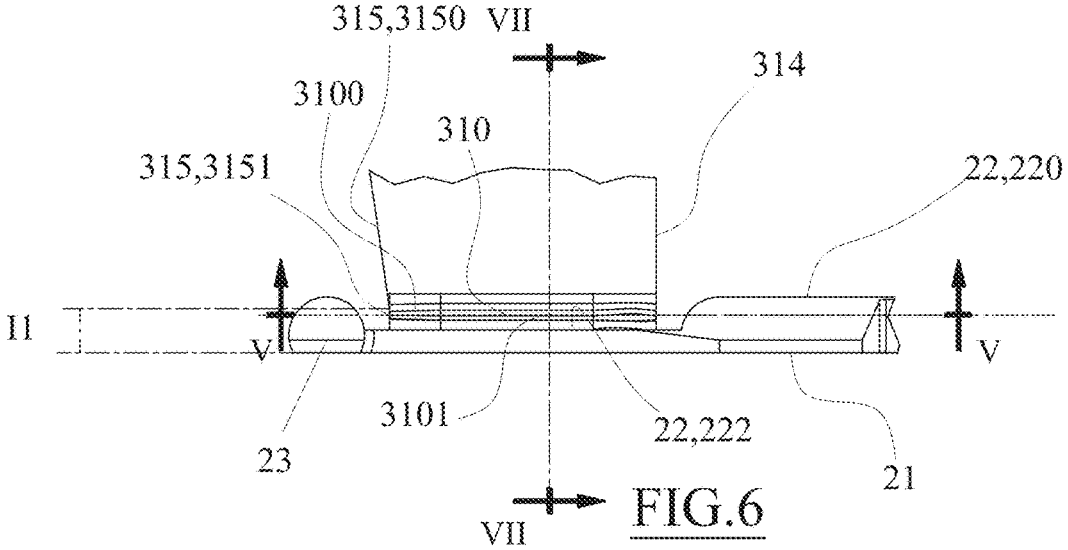
FIG. 6 is an enlargement of detail VI of FIG. 2.
Figure 7:
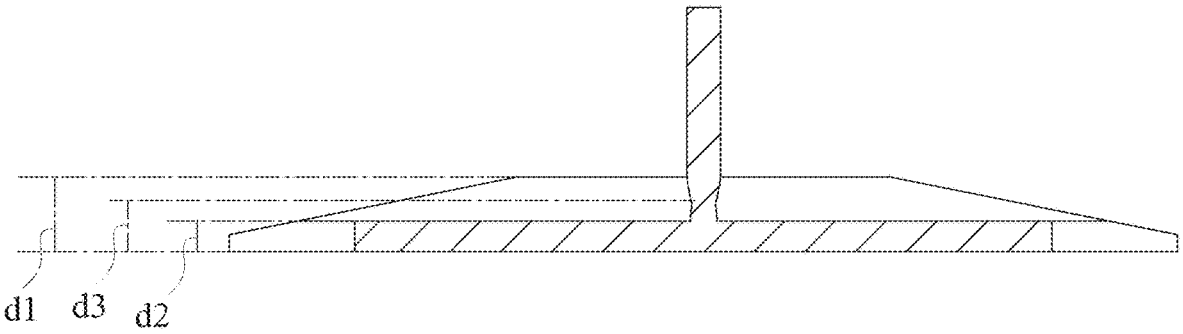
FIG. 7 is a sectional view along the trace of section VII-VII of FIG. 6.
Figure 8:
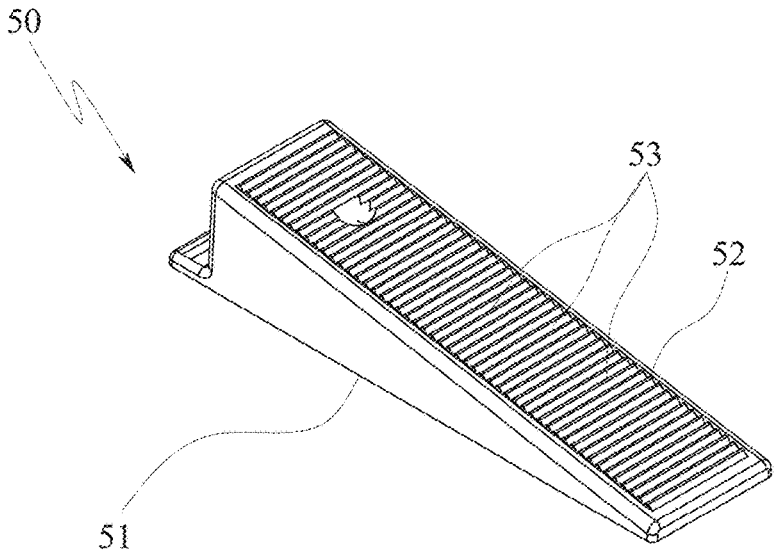
FIG. 8 is an axonometric view of a pressure wedge of a levelling spacer device, according to the invention.
Figure 9:
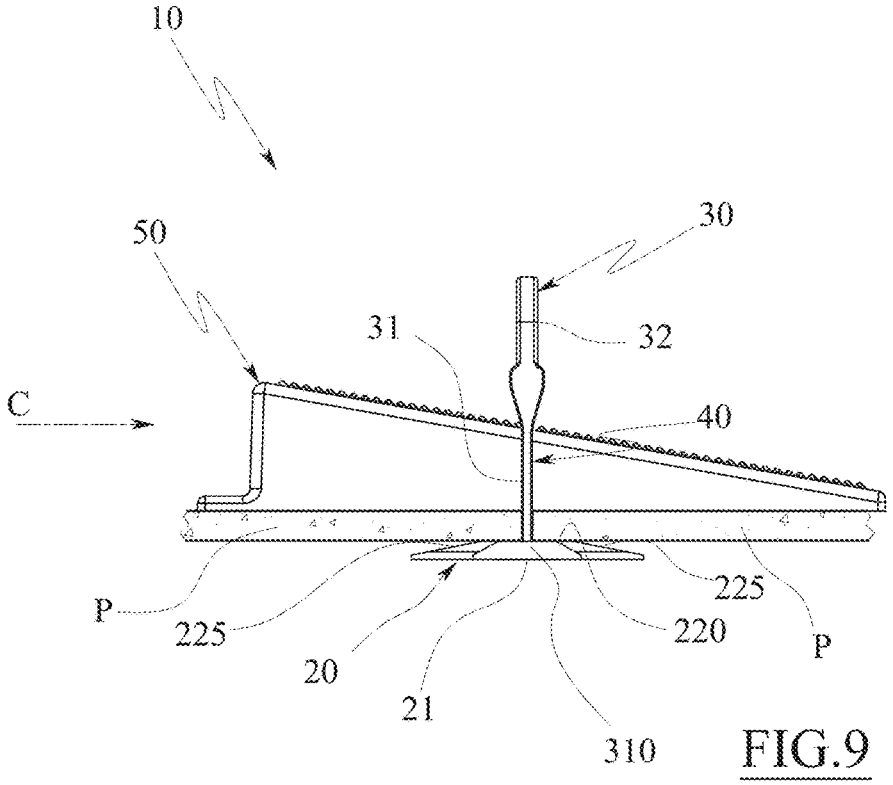
FIG. 9 is a side view of a levelling spacer device in operating configuration.
Figure 10A:
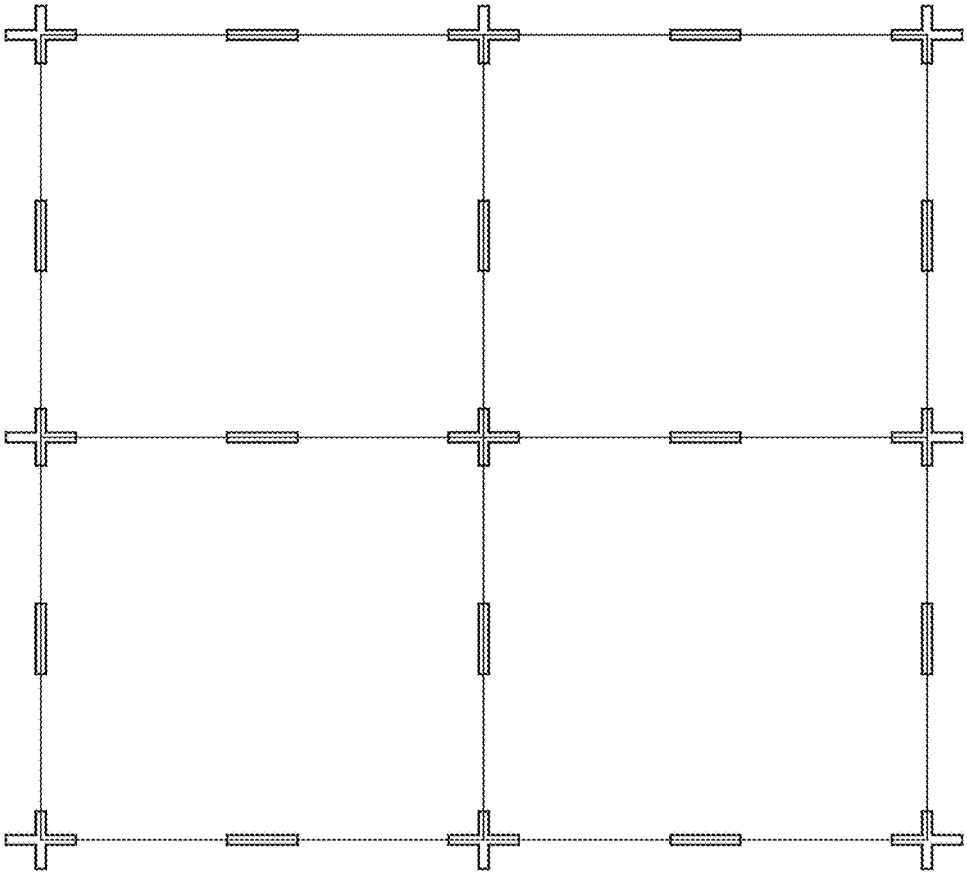
FIG. 10*a* is a schematic plan view of a first possible tile laying scheme, so-called "straight".
Figure 10B:
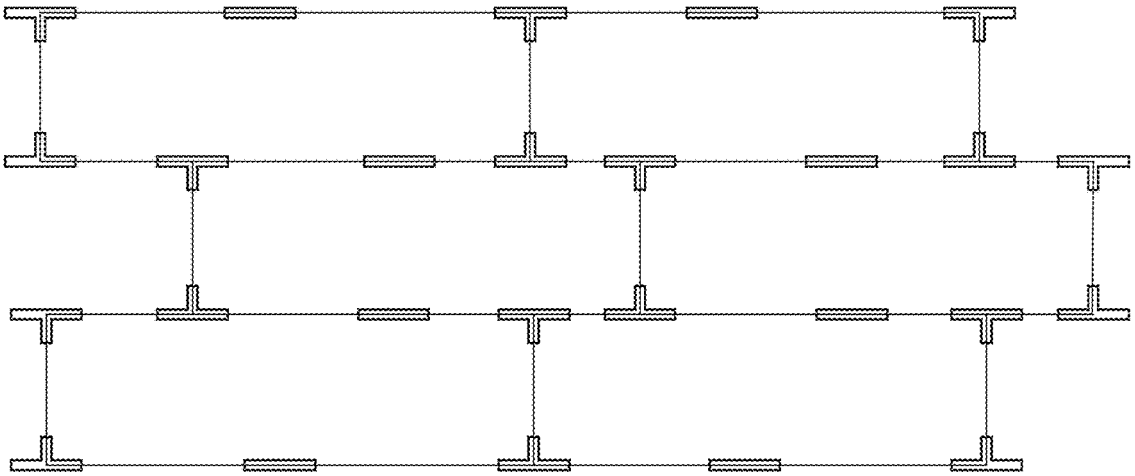
FIG. 10*b* is a schematic plan view of a second possible tile laying scheme, so-called "staggered".
Figure 10C:
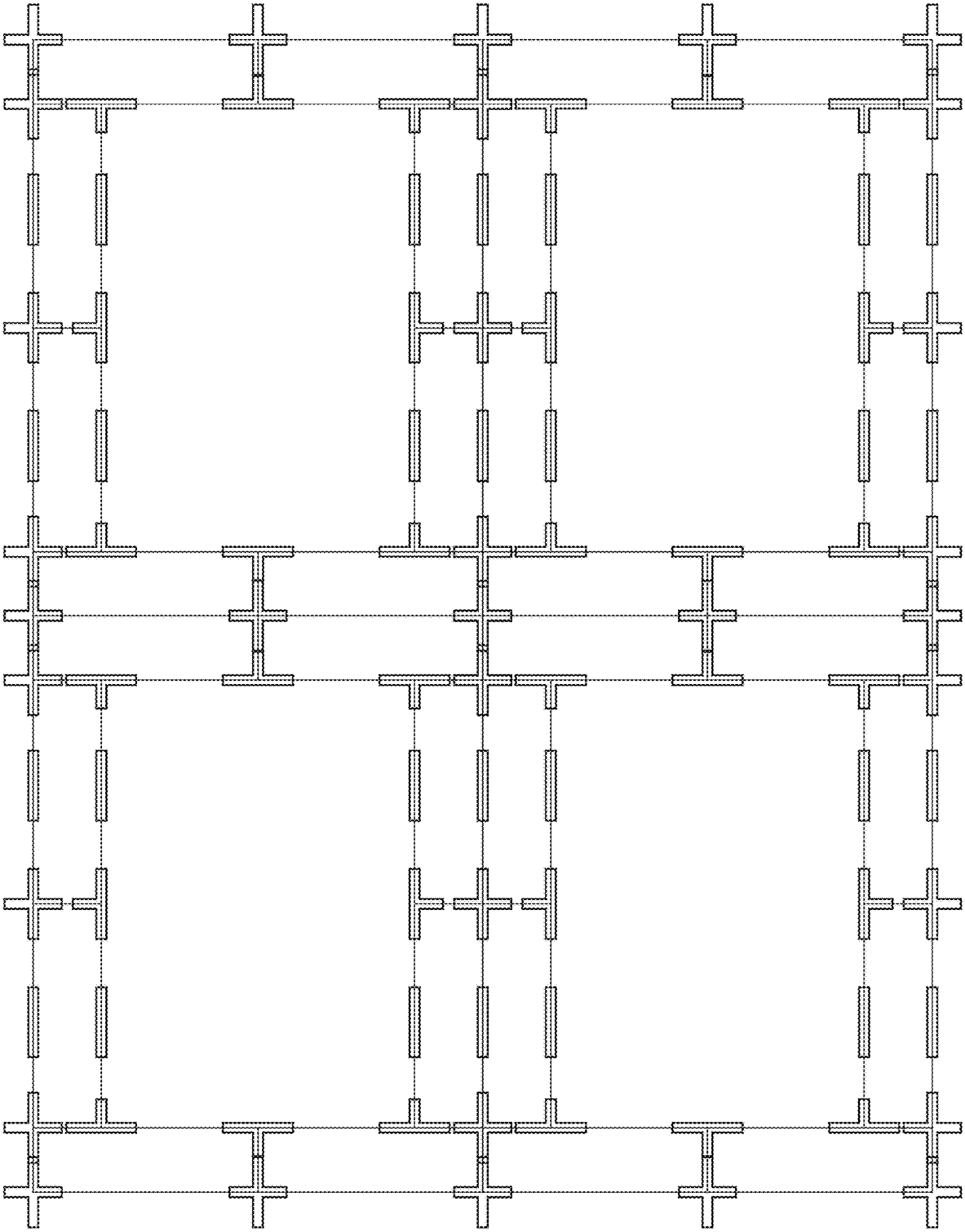
FIG. 10*c* is a schematic plan view of a third possible tile laying scheme, so-called "complex".

With particular reference to these figures, the reference number 10 generally designates a levelling spacer device adapted to facilitate the laying slab-type manufactured products, such as tiles and the like, generally indicated with the letter P, and adapted for coating surfaces, i.e. flooring, walls, ceilings and the like.

The device 10 comprises a base 20, which is, for example, slab-shaped with an enlarged shape, for example polygonal.

The base 20, in the example shown, is a monolithic body which has an irregular (plan) shape, for example substantially octagonal.

The base 20 comprises a lower surface 21, for example substantially flat or "V"-shaped or other shape.

The lower surface 21 is intended to be placed against (or otherwise come into contact with) a layer of adhesive disposed on the screed that is intended to be covered by the tiles P.

The base 20 also comprises an upper surface indicated as a whole with number 22.

The upper surface 22 can be substantially flat or variously shaped according to the needs.

In the illustrated examples, the upper surface 22 comprises a raised first portion 220 (central in the example) defining a support plane for two tiles P placed side by side.

The support plane, i.e., the highest surface portion of the upper surface 22 defining the first portion 220 (or in other words, the surface portion of the upper surface 22 furthest away from the lower surface 21, i.e., its lowest apical portion where provided) is located at a first distance d1 from the lower surface 21.

The support plane (i.e. the first portion 220 of the upper surface 22) is the surface of the base 20 furthest away from the lower surface 21.

In practice, the maximum thickness of the base 20 is defined by the first distance d1.

The support plane is substantially parallel to the lower (planar) surface 21.

The upper surface 22 of the base 20 furthermore comprises two second portions 222 (lateral in the example) mutually opposite with respect to the first (central) portion 220, for example symmetrical (and equal) with respect to a median plane M of the base 20 orthogonal to the support plane and intersecting the first portion 220 and the second portions 222.

Each second portion 222 defines a planar surface placed at a second distance d2 from the lower surface 21, wherein for example the second distance d2 is less than the first distance d1.

In practice, the thickness of each second portion 222 of the base 20 is defined by the second distance d2 and is less than the thickness of the first portion 220 of the base (wherein the thickness of the first portion 220 is the minimum thickness of the base 20).

It is not excluded, however, that at worst the second distance d2 may be equal to the first distance d1.

Alternatively, it is also possible to provide that the second distance d2 may be greater than the first distance d1, in which case the support plane for the tiles P would be defined by the second portion 222.

Each second portion 222 is, for example, planar and defines a plane substantially parallel to the lower surface 21 (planar) and the support plane (distinct therefrom).

The upper surface 22 comprises a connecting surface interposed between each planar surface and the support plane.

The connecting surface is substantially orthogonal to the planar surface and to the support plane, defining the elevation of a step between them.

Each second portion 222 of the upper surface 22, i.e. each planar surface, has a longitudinal development, i.e. has a prevalent development direction, along a longitudinal axis A, which is orthogonal to the median plane M of the base 20 which intersects the first portion 220 and the second portions 222.

In practice, each planar surface defines an elongated strip (having a length greater than the width) with longitudinal axis orthogonal to the aforesaid median plane M of the base 20 and placed at a lower level than the level defined by the support plane defined by the first portion 220 of the base 20.

The planar surface has a substantially trapezoidal plan shape, for example of an isosceles trapezoid, wherein the larger base is near the support plane, i.e. is joined thereto by means of the connecting surface, and the smaller base, opposite it, defines the lateral (free) end distal from the first portion 220 of the base 20.

The base 20, in the illustrated example, also comprises a reinforcing element 23, for example configured to strengthen the base 20 (with respect to the torsional or flexural stresses to which it is subjected during operation) and/or to widen the support plane defined by the first portion 220 and/or to widen the lower surface 21.

In the example, the base 20 comprises two reinforcing elements 223, for example, placed on opposite sides from the first portion 220. Each reinforcing element 223 is defined by a longitudinal beam, for example with circular cross-section (although it is not excluded that it may have a polygonal cross-section, for example rectangular), the longitudinal axis of which is orthogonal to the median plane M.

The reinforcing element 223 has a thickness that (at most) is equal to the maximum thickness of the base 20 (i.e., equal to the first distance d1 of the upper portion 220 from the lower surface 21).

In practice, each reinforcing member 223 defines a base wall (or directrix) substantially coplanar to the lower surface 21 and an opposite top wall (or directrix), which preferably is substantially coplanar to the first portion 220 of the upper surface 22.

The axial ends of each reinforcing element 223 are tapered, for example so as to define, each, a ramp degrading towards the outer periphery (i.e. the reinforcing elements have gradually decreasing thickness from a maximum thickness—central—to a minimum thickness—at the axial end –).

In practice, the top wall (or directrix) of each reinforcing element 223 defines an enlarged portion of the support plane, i.e., defines a rest for the tiles P (together with the first portion 220). For example, each second portion 222 is interposed (along a flanking direction parallel to the median plane M and the support plane defined by the first portion 220) between the first central portion 220 and (a top wall or directrix of) a respective reinforcing element 223.

In practice, each reinforcing element 223 is fixed to the smaller base of (the isosceles trapezoid defined by) the second portion 222.

It is not excluded that the reinforcing element 223 in an alternative variant may have a thickness greater than the maximum thickness of the base 20 (i.e. equal to the first distance d1 of the upper portion 220 from the lower surface 21), in which case the support plane for the tiles P may be defined (exclusively) by the reinforcing elements 223.

In the example, the length of the reinforcing element 223 is (slightly) greater than the length of the aforesaid smaller base.

The upper surface 22 of the base 20 comprises a pair of tilted surfaces 225 opposite with respect to the median plane M of the base 20 which intersects the first portion 220 and the second portions 222.

Each tilted surface 225 defines a ramp projecting from the end of the base 20 towards the aforesaid median plane M in a direction orthogonal to the median plane M and connecting the lower surface 21 of the base 20 to the support plane of the first portion 220 and/or defined by (the top walls or directrices of) the base 20.

Each tilted surface 225 has a maximum distance from the lower surface 21 equal to the first distance d1 and a minimum distance from the lower surface 21 comprised between zero and the second distance d2, preferably equal to the second distance d2.

Each tilted surface 225 lies on a tilted plane of an acute (internal) angle with respect to the lower surface 21.

In practice, each tilted surface 225 has a central portion connecting the first portion 220 to the lower surface 21 and two lateral portions each connecting the top wall or directrix of a respective reinforcing element 223 to the lower surface 21 (i.e., the base wall or directrix) thereof.

The base 20 comprises a pair of opposite slots 23 passing from the lower surface 21 to the upper surface 22, which are located at the first portion 220 of the upper surface 22.

Each slot 23 has an elongated shape, i.e. it has a prevalent development direction, along a longitudinal axis orthogonal to the median plane M of the base 20 which intersects the first portion 220 and the second portions 222.

In practice, each slot 23 has a longitudinal axis parallel to the longitudinal axis of the second portions 222 of the upper surface 22 of the base 20.

Each slot 23 is open laterally at a respective end of the base 20 distal from the median plane M.

Each slot 23 defines a longitudinal through slit of the base 20 from the end that is distal from the median plane M towards it and with a prevalent direction orthogonal thereto.

The length of each slot 23 is substantially equal to one-half of the length of the base 20 in the direction orthogonal to the median plane M, e.g., it is comprised between 0.4 times and 0.55 times the one-half of the length of the base 20 in the direction orthogonal to the median plane M.

For example, each slot 23 is adapted to intersect a respective tilted surface 225 (i.e., the central portion thereof) by dividing it into two separate portions along a direction parallel to the median plane M and to the lower surface 21.

The base 20, in particular the upper surface 22 thereof (except for the tilted surfaces 225), has a surface roughness substantially comprised between 20VDI-30VDI.

The device 10 comprises a spacer bridge 30 which, in use, is adapted to contact at least one portion of the facing sidewalls of the at least two tiles P resting on the support plane of the upper surface 22 of the base 20.

The bridge 30 comprises two (identical) legs 31 projecting from the base 20, for example, each leg is projecting from a respective second portion 222 of the upper surface 22 of the base 20 in an orthogonal direction with respect to at least the first portion 220 of the upper surface 22 of the base itself.

In practice, each leg 31 has a basal end with which it is connected to the base 20. The legs 31 are placed side by side along a parallel (and lying) flanking direction D on the median plane M of the base 20 and mutually spaced apart.

The bridge 30 then comprises a crosspiece 32 which joins the top of the two legs 31 and is arranged with a longitudinal axis parallel to the flanking direction D and parallel and at a distance from the upper surface 22 of the base 20.

The bridge 30 is for example made as a single body with the base 20, for example by injection molding of plastic material.

For example, the bridge 30 (as well as the base 20) is made of (or consists of) a polymeric material comprising (preferably, consisting of) polypropylene (PP) or polyethylene (PE), for example free of polyamides (Nylon).

For example, the polymeric material comprises a mixture of a first polypropylene, so-called structural, (60%) and of a second polypropylene, so-called elasticizing, (40%), wherein the second polypropylene has a greater elasticity than the elasticity of the first polypropylene.

The bridge 30 is defined globally by a slab-shaped body arranged parallel to the median plane M of the base 20, so that the median plane M of the base 20 is also a median plane of the bridge 30 itself.

Each leg 31 of the bridge 30 has a lower end fixed to (i.e., derived from) the base 20, or the upper surface 22 thereof, in particular is fixed to (i.e., derived from) the planar surface of the respective second portion 222.

Each leg 31 of the bridge 30 is substantially slab-shaped, i.e., it has a thickness (wherein thickness means the dimension developing in the direction orthogonal to the median plane M) defining the minimum dimension of the leg 31. The reinforcing elements 223 are placed on opposite sides with respect to the bridge 30 with respect to the flanking direction D, i.e., they are placed outside the legs 31 of the bridge 30 with respect to the flanking direction D (i.e., they define the free ends of the base 20 along said flanking direction D).

Each leg 31, for example, is interposed (along the flanking direction D between a reinforcing element 223 and the central portion 220.

In addition, the two reinforcing elements 223 (sleeves) are placed on opposite sides with respect to the first portion 220 and each second portion 222 is interposed (along the flanking direction D of the legs 31) between the first central portion 220 and a respective reinforcing element 223.

Furthermore, each leg 31 has a height (wherein height means the dimension developing in a direction parallel to the median plane M and orthogonal to the support plane defined by the base 20) defining the maximum dimension of the leg 31.

In practice, each leg 31 has a longitudinal axis (prevalent direction) orthogonal to the first portion 220 (or even to the planar surface of the second portion 222 from which it derives).

Each leg 31 has a height greater than the thickness of the tiles P to be placed side by side, so that the crosspiece 32 of the bridge 30 is always at a level (distance from the lower surface 21) greater than the level of the surface, in view, of the tiles P to be placed side by side.

Each leg 31 has a thickness that may be constant over the entire height of the leg 31 or, as in the example, variable (e.g., in sections) along the longitudinal axis thereof.

For example, each leg 31 comprises a central sector 311 axially interposed between the top of the leg (i.e., the portion of the leg that joins the crosspiece 32) and the basal end of the leg 31, wherein the central sector 311 is provided with two main faces opposite to the median plane M and parallel to each other.

The main faces of the central sector 311 are the zone of the leg 31 which comes into contact with the side-by-side tiles P resting on the first portion 220 of the upper surface 22 of the base 20 defining their mutual distance in a direction orthogonal to the median plane M.

The distance between the main faces (i.e., the thickness of the central sector 311) defines the width of the joint (interspace) between the tiles P.

For example, the thickness of each leg 31 at each main face is suitably calibrated, for example it is equal to 1 mm, 0.5 mm or multiples.

In practice, the height of the central sector 311 is at least equal greater than the thickness of the tiles P to be placed side by side, so that the crosspiece 32 of the bridge 30 is always at a level (distance from the lower surface 21) greater than the level of the surface, in view, of the tiles P to be placed side by side.

Furthermore, the height of the central sector 311 represents the prevalent height of the height of the entire leg 31.

In the case where the thickness of the leg 31 is constant along the entire longitudinal development thereof, then the leg 31 consists entirely of the aforesaid central sector 311.

Each leg 31, further, may (alternatively) comprise a top connecting sector 312, which is configured to join the leg 31 (i.e., the top of the central sector 311) to the crosspiece 32.

For example, the top connecting sector 312 has a greater thickness (overall) than the thickness of the central sector 311, e.g. increasing (steadily) from its lower end (joined to the upper end of the central sector) to its upper end defining the top end of the leg 31 itself (and joining the crosspiece 32).

Each leg 31 then comprises a basal connecting block 313 configured to interconnect/join the leg 31 (i.e., the lower end of the central sector 311) to the (upper surface 22 of the) base 20, i.e., the respective second portion 222.

The block 313 may have, as will be better described below, a thickness (globally) lower than (or at most equal to) the mutual distance between the two sidewalls of the central sector 311.

The block 313 has an upper end connected to the central sector 311 and a lower end, coinciding with the basal end of the leg 31 as a whole, directly connected to the (upper surface 222 of the) base 20 (i.e. to the respective second portion 222) and an upper end joined to the lower end of the central sector 311.

Each leg 31, then, has a width (wherein width means the dimension developing in a direction parallel to the median plane M and parallel to the support plane defined by the base 20, i.e. parallel to the flanking direction D) defining a dimension, for example, comprised between the height and the thickness of the leg 31.

Preferably, each leg 31 has a variable width along the height of the leg 31, i.e., along the longitudinal development thereof.

For example, each leg 31 has a pair of opposite sidewalls that laterally delimit the leg 31.

More in detail, each leg 31 comprises an inner sidewall 314 provided with a top end (at the top end of the leg 31 and concurring to define the same) that joins (directly) to the crosspiece 32 and an opposite base end (at the basal end of the leg 31 and concurring to define the same) that joins to (the upper surface 22 of) the base 20 (i.e. the respective second portion 222 thereof).

The inner sidewall 314 of each leg 31 faces the inner sidewall 314 of the other leg 31 and is placed at a predetermined (non-zero) distance DO therefrom, for example equal to or greater than the width of the first portion 220 (in the flanking direction D of the legs 31).

For example, the inner sidewall 314 of each leg 31 is planar and lies in a plane orthogonal to the median plane M and the support plane (defined by the base 20, i.e., orthogonal to the first portion 220 of the upper surface 22)

In practice, the inner (planar) sidewall 314 delimits the central sector 311 and (where provided) the top connecting sector 312 and the block 313) of the leg 31 (squared with the main faces of the central sector 311).

Each leg 31, moreover, comprises an opposite outer sidewall 315, which is provided with a top end (at the top end of the leg 31 and concurring to define the same) that joins (directly) to the crosspiece 32 and an opposite base end (at the basal end of the leg 31 and concurring to define the same) that joins to (the upper surface 22 of) the base 20 (i.e. of the respective second portion 222 thereof).

The top end of the outer sidewall 315 is placed at a first distance W1 from the top end of the inner sidewall 314 along the flanking direction D.

Further, the base end of the outer sidewall 315 is placed at a second distance W2 from the base end of the inner sidewall 314 along the flanking direction D.

In particular, the second distance W2 is lower than the first distance W1, i.e., the ratio between the second distance W2 and the first distance W1 is lower than 1:1.

Preferably, the aforesaid ratio is comprised between 0.95:1 and 0.5:1, more preferably between 0.9:1 and 0.8:1 e.g. equal to 0.84+/−1:1.

For example, the second distance W2 is substantially equal to (or slightly lower than) half the distance DO between the inner sidewalls 314 of the two legs 31.

For example, the second distance W2 is lower than the width of the planar surface of the respective second portion 222 (from which it derives), in practice a (hollow) gap is defined between the basal end of each leg 31 and the connecting surface (joining the first portion 220 and the second portion 222) and/or the reinforcing element 223.

The second distance W2 is the minimum distance between the inner sidewall 314 and the outer sidewall 315 of the respective leg 31, i.e. it defines the minimum width of the (entire) leg 31.

Particularly, the outer sidewall 314 and the inner sidewall 314 converge with each other so that the width of the leg 31 decreases from the top end towards the basal end of the leg, i.e., so that the basal end of the leg 31 has a width lower than the top end of the leg 31 (or, in other words, so that the basal end of the leg 31 is tapered along the flanking direction D with respect to the top end of the leg).

In more detail, the (only) outer sidewall 315 converges towards the inner sidewall 314.

The outer sidewall 315 (or at least a portion thereof, as will be described below) lies on a tilted plane which intersects the lying plane of the inner sidewall 314 on an imaginary intersecting line, which is orthogonal to the median plane M and lies below the upper surface 22 of the base 20, preferably on the opposite side of the leg 31 with respect to the base 20 (i.e. inferiorly to the lower surface 21 of the base 20).

The outer sidewall 315 of each leg comprises (or consists of) a (single) tilted section 3150, converging towards the inner sidewall.

The tilted section 3150, in essence, is planar (or rounded) and lies in the aforesaid tilted plane.

The tilted section 3150 laterally delimits (all and only) the central sector 311 of the leg 31.

In practice, a height of the tilted section 3150 (along the direction of longitudinal development of the leg 31) is equal to the height of said central sector 311.

The height of the tilted section 3150, for example, is greater than the width (e.g., the minimum width, preferably the maximum width) of the leg 31 in the flanking direction D, i.e., is greater than (the second distance W2 and/or) the first distance W1 above.

For example, the outer sidewall 311 of each leg 31 may comprise (like in the example) a lower section 3151 proximal to the base 20, which laterally delimits (all and only) the block 313.

The lower section 3151 is planar (or rounded) and lies on a plane parallel to the inner sidewall 314 of the same leg 31.

In practice, the width of the block 313 is constant along its entire height and is equal to the second distance W2.

For example, the base end of the outer sidewall 315 coincides with a base end of the lower section 3151.

Superiorly, instead, the lower section 3151 (where provided, or the base 20) and the tilted section 3150 are connected, or incident, in a first (sharp) corner of a dihedral angle lower than the flat angle (facing the outside of the leg 31), which is orthogonal to the median plane M and is placed at a predetermined first incidence distance I1 not zero from the lower surface 21 of the base 20.

For example, the first incidence distance I1 is lower than or equal to the first distance d1 (i.e., the maximum distance between the lower surface 21 and the upper surface 22 of the base 20).

Again, the outer sidewall 311 of each leg 31 may comprise (like in the example) an upper section 3153 proximal to the crosspiece 32, which laterally delimits (all and only) the top connecting sector 312.

The upper section 3152 is planar (or rounded) and lies on a plane parallel to the inner sidewall 314 of the same leg 31.

In practice, the width of the top connecting sector 312 is (substantially) constant along its entire height and is equal to the first aforesaid distance W1.

The top end of the outer sidewall 315 coincides with a top end of the upper section 3152.

Inferiorly, instead, the upper section 3152 (where provided, or the crosspiece 32) and the tilted section 3150 are connected, or incident, in a second (sharp) corner of a dihedral angle lower than the flat angle (facing the outside of the leg 31), which is orthogonal to the median plane M and is placed at a predetermined second distance I2 not zero from the upper surface 21 of the base 20.

The distance (along the longitudinal development of the leg 31, i.e., along its height) between the first corner and the second corner is equal to the height of the tilted section 3150.

Again, the height of the tilted section 3150 is greater than or equal to the sum of the height of the upper section 3152 and the lower section 3151 (where provided), e.g. higher than or equal to twice that sum.

Again, each leg 31 of the bridge 30 is connected to the (upper surface 22 of the) base 20, i.e. to the planar surface of the respective second portion 222 of the base 20, frangibly, for example by a predefined weakening zone (of the leg 31).

For example, said weakening zone is arranged at the block 313, i.e., it is contained along the longitudinal development direction of the leg 31 between the second portion 222 of the base 20 and the support plane defined by the first position 220 of the base.

The weakening zone, in particular, comprises a predetermined fracture line 310, which will be better described below.

The fracture line 310 is substantially parallel to the planar surface defined by the first portion 220 of the upper surface 22 (and/or the support plane) and is placed at a predetermined cutting distance d3 from the lower surface 21.

In a preferred embodiment, the cutting distance d3 at which the fracture line 310 is placed is intermediate (included) between the first distance d1 and the second distance d2.

The cutting distance d3 is lower than or equal to the first incidence distance I1. It is not excluded that the cutting distance d3 may be substantially equal to or (slightly) greater than the first distance d1.

The fracture line 310 is defined at the block 313, for example in a zone proximal to the lower end of the same and/or intermediate between the lower end thereof (or coinciding therewith) and the upper end thereof (excluded).

The fracture line 310 comprises a longitudinal cut 3100 developing longitudinally with a longitudinal axis parallel to the flanking direction D of the legs 31.

For example, the longitudinal cut 3100 of each leg 31 is aligned along the flanking direction D with the longitudinal cut 3100 of the other leg 31.

The longitudinal cut 3100 of each leg 31 extends across a predetermined section of the width of the respective leg 31, preferably for the entire width (equal to the second distance W2) of the respective leg 31 (i.e., of the block 313 on which it is defined), i.e. it is fully developed.

Preferably, each longitudinal cut 3100 defines a zone having a reduced transverse section with respect to the transverse section (in any direction and in particular in the direction orthogonal to the median plane M) of the entire leg 31 and, in particular, of the block 313.

The longitudinal cut 3100 in practice defines a weakening zone of the respective leg on which the fracture of the bridge 30 preferentially develops with respect to the base 20.

The longitudinal axis of the longitudinal cut 3100 is parallel to the first portion 220 (of the upper surface 22 of the base 20), i.e., to the support plane, and, for example, to the planar surface of the respective second portion 222.

The longitudinal cut 3100 has a section that is transverse (i.e. with respect to a plane orthogonal to the flanking direction D, i.e. to the longitudinal axis of the respective longitudinal cut 3100) having a concave shape, with concavity turned outwards (i.e. from the side opposite to the median plane M).

For example, the aforesaid transverse section is rounded according to a first radius of curvature R1.

In practice, the shape of the longitudinal cut is substantially semi-cylindrical or defines a dihedral ("V"-shaped) angle whose vertex is turned towards the inside of the leg 31 and is open on the opposite side from the median plane M.

The first radius of curvature R1 is substantially comprised between 0.4 and 0.2 mm, preferably equal to 0.3 mm.

The cut depth of the longitudinal cut 3100 defined along the thickness of the block 313 is substantially comprised between 0.01 mm and 0.02 mm.

Each leg 31, i.e. each block 313, comprises a pair of identical longitudinal cuts 3100, symmetrically arranged with respect to the median plane M of the bridge 30 (and of the base 20) which contains the flanking direction D, i.e. the longitudinal axis A of the longitudinal cut 3100.

In practice, the weakening zone of the leg 31, on which the fracture of the bridge preferentially develops, is defined at the plane joining the vertices of the rounded concave shape according to a first radius of curvature R1 defining the two longitudinal cuts 3100 of each leg 31.

In practice, the thickness of the weakening zone is equal to the thickness of the leg 31, preferably of the block 313, minus twice the cut thickness.

Advantageously, each longitudinal cut 3100 is then connected to the portion of the leg 31 (i.e. of the block 313) above it by means of a rounded connecting surface according to a second radius of curvature, opposite and greater than the first radius of curvature R1 (for example comprised between 0.3 mm and 0.5 mm, preferably equal to 0.4 mm).

Each fracture line 310 further comprises at least one trigger element 3101 of the fracture, which is localized in a predetermined trigger zone of the longitudinal cut 3100 along the longitudinal axis A thereof.

The trigger element 3101 defines the trigger zone of the longitudinal cut having the minimum thickness of the entire leg 31, i.e. having a thickness less than the thickness of the weakened zone of the longitudinal cut 310 (outside the trigger zone itself).

This minimum thickness (localized at the trigger element 3101) can be comprised between the zero thickness (comprised) and the thickness of the weakened zone of the longitudinal cut 310 (not comprised).

Advantageously, the trigger element 3101 is localized close to at least one axial end of the longitudinal cut 3101 (proximal thereto).

Preferably, but not limited to, the trigger element 3101 is localized close to at least one axial end of the longitudinal cut 3101, proximal to the trigger element at a predetermined non-null interspace distance therefrom, for example at an interspace distance along the longitudinal axis of the longitudinal cut 3100 comprised between the thickness of the weakened zone (of the longitudinal cut 3100) and the thickness of the central sector 311 (and/or of the block 313).

Each fracture line 310 could comprise, as in the illustrated case, a single trigger element 3101 placed close to a single axial end (proximal thereto) of the respective longitudinal cut 3100, preferably the outer axial end, i.e., close to the outer sidewall 315.

It is not excluded that each fracture line 310 may comprise a pair of trigger elements 3101 separated from each other along the longitudinal axis A of the longitudinal cut 3100 and, for example, each placed close to a respective axial end (proximal thereto) of the longitudinal cut 3100, preferably at the aforesaid predetermined non-null interspace distance therefrom.

In a preferred embodiment shown, each trigger element 3101 comprises or consists of a transverse cut which incises/intersects the longitudinal cut 3100 in the aforesaid predetermined trigger zone, i.e. at the predetermined (null or non-null) distance from the respective axial end of the longitudinal cut 3100.

In particular, at least one trigger element 3101 of each leg 31 (in the example the one placed at the external axial end of the longitudinal cut 3100), in this embodiment, is formed by a pair of (identical) opposite transverse cuts 3101, symmetrically arranged with respect to the median plane M of the bridge 30 (and of the base 20) which contains the flanking direction D, i.e. the longitudinal axis A of the longitudinal cut 3100.

Each transverse cut 3101 has a substantially three-dimensional "V" or cradle shape, for example with a rounded vertex, which for example incises/intersects the longitudinal cut 3100, i.e. the vertex thereof (or minimum section), in the aforesaid predetermined trigger zone, i.e. at the predetermined (non-zero) interspace distance from the respective axial end (proximal thereto) of the longitudinal cut 3100.

In particular, each transverse cut 3101 is defined by a dihedral angle whose vertex corner faces the inside of the leg 31 and is open on the opposite side with respect to the median plane M.

The vertex corner of the dihedral angle formed by each transverse cut 3101 develops longitudinally in a transverse direction, preferably orthogonal to the longitudinal axis A of the longitudinal cut 3100, i.e. it develops substantially orthogonal to the lower surface 21 of the base 20.

The vertices of the transverse cuts 3101 of each pair of transverse cuts 3101 which forms a trigger element 3101 are spaced by a (non-zero) distance less than the distance between the vertices of the longitudinal cuts 3100 of the same leg 31.

Furthermore, at least one trigger element 3101 of each leg 31 (in the example the one placed at the inner axial end of the longitudinal cut 3100), in this embodiment, is formed by a single degrading wall whose vertex (preferably orthogonal to the longitudinal axis A of the longitudinal cut 3100, i.e. it develops substantially orthogonal to the lower surface 21 of the base 20) is placed at the respective axial (inner) end of the longitudinal cut 3100, i.e. of the leg 31.

It is not excluded that each trigger element 3101 may comprise or consist of a through hole (with a closed cross-section, the entire perimeter of which is contained in the leg) from side to side for the entire thickness of the respective leg 31 or blind, that is of the respective block 313, wherein the through axis of the hole 3101 is transverse with respect to the longitudinal axis of the longitudinal cut 3100 (i.e. orthogonal to the median plane M). The hole may be, for example, with constant circular (cylindrical) cross-section or (conical) decreasing cross-section or have any shape, for example polygonal (prismatic or pyramidal).

Coming back then to the overall shape of the leg 31, the crosspiece 32, which as said above extends longitudinally with the longitudinal axis thereof parallel to the flanking direction D, comprises a transverse section (with respect to a plane orthogonal to the median plane M and orthogonal to this flanking direction D) defining a thicker zone in a zone proximal to the upper end of the legs 31 and with whole longitudinal development.

This thicker zone defines a reinforcing beam for the bridge 30.

This thicker zone is overhanging at the top with a thinner gripping portion and is connected to the legs 31 by means of tilted connecting surfaces (described above).

The reinforcing beam, in the zone interposed between the legs 31, i.e. superimposed on the first portion 220 of the upper surface 22 of the base 20, ends at the bottom with a shaped edge, for example in a "V" shape with the vertex facing the first portion 220.

The distance of the shaped edge from the first portion 220 of the upper surface 22 of the base 20 is greater (abundantly) than the thickness of the tiles P to be laid and is greater than or equal to (or comparable to) the height (of the inner sidewall 314) of the legs 31.

The crosspiece 32, moreover, may have a longitudinal development (length) less than or equal to the aforesaid maximum distance between outer sidewalls 315 of the legs 31.

Furthermore, the crosspiece 32 could have holes or lightening openings 320, for example through- or blind ones, defined above the reinforcing beam of the bridge 30.

The bridge 30, with its portal shape described above, and the base 20 joined thereto, delimit a through opening 40 which crosses the bridge 30 and the base 20 in a direction orthogonal to the median plane M of the same, i.e. in a crossing direction C orthogonal to the median plane M (i.e. orthogonal to the flanking direction D between the legs 31).

The through opening 40 is perimetrically delimited (at the top) by the crosspiece 32, (laterally) by (the inner sidewalls 314 of) the legs 31 of the bridge 30 and (at the bottom) by (the first portion 220 of) the upper surface 22 of the base 20.

More in detail, the through opening 40 is delimited at the top by the shaped edge of the reinforcing beam of the crosspiece 32, below (almost totally) by the first portion 220 of the upper surface 22 of the base 20 (i.e. the zone of the same underlying the crosspiece 32) and laterally by the inner sidewalls 314 of the legs 31.

The through opening 40 overall has a substantially rectangular shape.

The device 10 further comprises a pressure wedge 50, separated from the base 20 and from the bridge 30.

The pressure wedge 50 is a right-angled wedge, for example it is provided with a lower flat surface 51 and adapted to be arranged, in use, parallel to the support plane of the first portion 220 of the upper surface 22 of the base 20 and an upper surface 52 tilted with respect to the lower surface 51 and provided with abutment elements, such as teeth 53 or knurls.

The pressure wedge 50 then comprises two parallel sidewalls.

The pressure wedge 50 has variable (and steadily growing) thickness along its longitudinal axis from one end towards the opposite end.

The pressure wedge 50 is configured so that it can be axially fitted with clearance through the through opening 40 defined between the base 20 and the bridge 30 of the device 10 along the crossing direction C which is orthogonal to the median plane M of the aforesaid bridge 30 and of the base 20.

For example, the maximum height of the pressure wedge 50 (maximum distance between the lower surface 51 thereof and the upper surface 52 thereof) is less than the height of the through opening 40 defined by the distance between the crosspiece 32 (i.e. the shaped edge thereof) and the upper surface 22 of the base 20 (i.e. the support plane thereof).

The shaped edge of the crosspiece 32 is adapted to engage the teeth 53 substantially like a pop-up during the translation inside the through opening 40 along the crossing direction C.

The width of the pressure wedge 50 is substantially equal to (slightly less than) the distance between the two legs 31 (i.e. between the two facing edges thereof).

The pressure wedge 50 is adapted to be fitted inside the through opening 40 and to slide, with the lower surface 51 resting on the surfaces, in view, of the tiles P resting on the support plane defined by the upper surface 22 of the base 20, in such a way that the upper surface 52 of the pressure wedge 50 come into forced contact with the shaped edge of the crosspiece 32 and the same pressure wedge 50 is thus pressed against both tiles P, placed on opposite sides with respect to the bridge 30, due to the thrust of the same towards the base 20 and the levelling of the same.

In light of the above, the operation of the device 10 is as follows.

The device 10 allows the laying of tiles P according to different laying schemes as illustrated in FIG. 33*a*-33*c*.

In order to coat a surface with a plurality of tiles P, it is sufficient to spread a layer of adhesive over it and, subsequently, it is possible to lay the tiles P.

In practice, where the first tile is to be arranged, it is sufficient to position a first device 10, whose base 20 is intended, for example, to be placed under four corners of respective two/four tiles P.

Once the base 20 has been positioned, it is sufficient to position the two/four tiles P so that each of them has a portion of the lateral sidewall in contact respectively with a sidewall of one or both legs 31.

In this way, the equidistance between the two/four tiles P that surround the bridge and are resting on the support plane of the base 20 is ensured.

When for example the tiles P have particularly large dimensions, then it is possible to position a device 10 also at a median zone of the lateral sidewall of the tile itself.

In doing so, the tile P rests on one or more support planes of respective bases 20.

Generally, the work is done by first laying a tile P and subsequently at a corner or a sidewall thereof, a base portion 20 of the device 10 is inserted thereunder.

In this circumstance, the tilted surfaces 225 and the elongated conformation in a direction orthogonal to the median plane M of the second portions 222 of the upper surface 22 (lowered with respect to the first portion 220) and, for example, the slots 23 play an important role in facilitating (jointly) the wedging of the base 20 below the laying surface of the tile P however allowing the adhesive not to be completely scraped away from the laying surface itself.

Once the various bases 20 have been positioned with their respective bridges 30 which stand above the surfaces in view of the side-by-side tiles P as described above, until the adhesive has still not completely solidified, it is proceeded with the insertion of the various pressure wedges 50 inside each through opening 40, which, by pressing on the surfaces in view of the tiles P, locally at the various (median or corner) points, allow the perfect levelling of the surfaces in view of the same tiles.

Finally, when the adhesive has solidified and set, it is proceeded with breaking the long bridge 30, causing, for example, by applying an impulsive force directed parallel to the median plane M and imparted in the impact zone defined between the outer sidewall 315 and the crosspiece 32, the fracture along the fracture line 310 and thus removing the same bridge 30 (single-use) and the pressure wedge 50 (reusable) so as to be able to fill the joints between the tiles P without the base being visible on the finished surface and no part of the base 20 being interposed between the tiles themselves.

In practice, the fracture is triggered in a controlled manner in the weakening zone, for example starting from one of the trigger elements 3101 of each leg 31 and propagates along the longitudinal axis of the longitudinal cut 3100 up to the opposite axial end thereof.

The invention thus conceived is susceptible to several modifications and variations, all falling within the scope of the inventive concept.

Moreover, all the details can be replaced by other technically equivalent elements.

In practice, the materials used, as well as the contingent shapes and sizes, can be whatever according to the requirements without for this reason departing from the scope of protection of the following claims.

The invention claimed is:

1. A levelling spacer device for the laying of slab-shaped products (P) for coating surfaces, comprising:

at least one base having a lower surface and an opposite upper surface defining a support plane for two slab-shaped products placed side by side;

a spacer bridge perimetrically delimiting a through opening adapted to be crossed by a pressure wedge along a crossing direction, wherein the bridge is provided with:

at least two legs placed side by side between each other along a flanking direction orthogonal to the crossing direction and each one projecting from a respective portion of the upper surface of the base, in a direction orthogonal thereto, wherein each leg of the bridge is frangibly connected to the respective base portion; and a crosspiece, which joins the top of the two legs along the flanking direction;

wherein each leg has:

an inner sidewall provided with a top end which joins at the cross-piece and a base end which joins at the upper surface of the base, wherein the inner sidewall delimits laterally the through opening; and an opposite outer sidewall, wherein the outer sidewall is provided with a top end which joins at the crosspiece and a base end which joins at the base, wherein the top end of the outer sidewall is placed at a first distance along the flanking direction from the top end of the inner sidewall and the base end of the outer sidewall is placed at a second distance along the flanking direction from the base end of the inner sidewall, wherein the outer sidewall of each leg converges towards the inner sidewall and/or the inner sidewall of each leg converges towards the outer sidewall, so that a ratio between the second distance and the first distance is lower than 1;

wherein the outer sidewall of each leg comprises a tilted section, converging towards the inner sidewall, wherein a height of the tilted section in a longitudinal extension direction of the leg is higher than the width of the leg in the flanking direction; and the outer sidewall of each leg comprises a lower section that is proximal to the base and parallel to the inner sidewall of the leg itself, wherein the base end of the outer sidewall coincides with a base end of the lower section, the lower section and the tilted section are incident in a first corner of a dihedral angle that is lower than the opposite plane angle placed at a predetermined first incidence distance that is not null from the lower surface of the base.

2. The device according to claim 1, wherein the second distance is a minimum distance between the inner sidewall and the outer sidewall of the respective leg.

3. The device according to claim 1, wherein the outer sidewall of each leg comprises an upper section that is proximal to the crosspiece and parallel to the inner sidewall of the leg itself, wherein the top end of the outer sidewall coincides with a top end of the upper section, the upper section and the tilted section are incident in a second corner of a dihedral angle that is greater than the plane angle placed at a second predetermined distance of incidence not null from the lower surface of the base, wherein the distance between the first corner and the second corner is equal to a height of the tilted section in a longitudinal extension direction of the leg.

4. The device according to claim 3, wherein the height of the tilted section in a longitudinal extension direction of the leg is higher than or equal to the sum of the upper section and lower section height in the same longitudinal extension direction.

5. The device according to claim 1, wherein each leg of the bridge is frangibly connected to the respective base portion by a respective predefined weakening zone.

6. The device according to claim 5, wherein the weakening zone comprises a fracture line, wherein the fracture line comprises:

a longitudinal cut extending for a predetermined section of the width of the respective leg with a longitudinal axis parallel to the flanking direction.

7. The device according to claim 6, wherein the fracture line further comprises:

at least one trigger element of the fracture localized in a predetermined trigger zone of the longitudinal cut along the longitudinal axis thereof.

8. The device according to claim 6, wherein the longitudinal cut is placed at a predetermined cutting distance from the lower surface of the base.

9. The device according to claim 8, wherein the cutting distance is lower than or equal to the first incidence distance.

10. The device according to claim 8, wherein the cutting distance is such to be arranged below the level of a surface, in view, of the slab-shaped products resting on the base with a support surface thereof opposite to the surface, in view, thereof.

11. The device according to claim 8, wherein the cutting distance is lower than a maximum distance between the upper surface and the lower surface of the base.

12. The device according to claim 4, wherein the first incidence distance is lower than or equal to a maximum distance between the upper surface and the lower surface of the base.

13. The device according to claim 1, wherein the base comprises two reinforcing elements placed externally to the legs of the bridge with respect to the flanking direction.

14. The device according to claim 13, wherein each reinforcing element is defined by a longitudinal beam the longitudinal axis of which is orthogonal to the flanking direction.

15. A levelling spacer device for the laying of slab-shaped products for coating surfaces, comprising:

at least one base having a lower surface and an opposite upper surface defining a support plane for two slab-shaped products placed side by side;

a spacer bridge perimetrically delimiting a through opening adapted to be crossed by a pressure wedge along a crossing direction, wherein the bridge is provided with:

at least two legs placed side by side between each other along a flanking direction orthogonal to the crossing direction and each one projecting from a respective portion of the upper surface of the base, in a direction orthogonal thereto, wherein each leg of the bridge is frangibly connected to the respective base portion; and a crosspiece, which joins the top of the two legs along the flanking direction;

wherein each leg has:

an inner sidewall provided with a top end which joins at the cross-piece and a base end which joins at the upper surface of the base, wherein the inner sidewall delimits later-ally the through opening; and an opposite outer sidewall, wherein the outer sidewall is provided with a top end which joins at the crosspiece and a base end which joins at the base, wherein the top end of the outer sidewall is placed at a first distance along the flanking direction from the top end of the inner sidewall and the base end of the outer sidewall is placed at a second distance along the flanking direction from the base end of the inner sidewall, wherein the outer sidewall of each leg converges towards the inner sidewall and/or the inner sidewall of each leg converges towards the outer sidewall, so that a ratio between the second distance and the first distance is lower than 1;

wherein each leg of the bridge is frangibly connected to the respective base portion by a respective predefined weakening zone, wherein the weakening zone comprises a fracture line, wherein the fracture line comprises a longitudinal cut extending for a predetermined section of the width of the respective leg with a longitudinal axis parallel to the flanking direction, wherein the longitudinal cut is placed at a predetermined cutting distance from the lower surface of the base; and wherein the cutting distance is lower than a maximum distance between the upper surface and the lower surface of the base.

16. A levelling spacer device for the laying of slab-shaped products for coating surfaces, comprising:

at least one base having a lower surface and an opposite upper surface defining a support plane for two slab-shaped products placed side by side;

a spacer bridge perimetrically delimiting a through opening adapted to be crossed by a pressure wedge along a crossing direction, wherein the bridge is provided with:

at least two legs placed side by side between each other along a flanking direction orthogonal to the crossing direction and each one projecting from a respective portion of the upper surface of the base, in a direction orthogonal thereto, wherein each leg of the bridge is frangibly connected to the respective base portion; and a crosspiece, which joins the top of the two legs along the flanking direction;

wherein each leg has:

an inner sidewall provided with a top end which joins at the cross-piece and a base end which joins at the upper surface of the base, wherein the inner sidewall delimits later-ally the through opening; and an opposite outer sidewall, wherein the outer sidewall is provided with a top end which joins at the crosspiece and a base end which joins at the base, wherein the top end of the outer sidewall is placed at a first distance along the flanking direction from the top end of the inner sidewall and the base end of the outer sidewall is placed at a second distance along the flanking direction from the base end of the inner sidewall, wherein the outer sidewall of each leg converges towards the inner sidewall and/or the inner sidewall of each leg converges towards the outer sidewall, so that a ratio between the second distance and the first distance is lower than 1, wherein the base comprises two reinforcing elements placed externally to the legs of the bridge with respect to the flanking direction, and wherein each reinforcing element is defined by a longitudinal beam the longitudinal axis of which is orthogonal to the flanking direction.

* * * * *